US006943685B2

(12) United States Patent
Seo

(10) Patent No.: US 6,943,685 B2
(45) Date of Patent: Sep. 13, 2005

(54) INTRUSION DETECTING DEVICE

(75) Inventor: Cholmin Seo, Otsu (JP)

(73) Assignee: Optex Co., Ltd., Shiga (JP)

( * ) Notice: Subject to any disclaimer, the term of this patent is extended or adjusted under 35 U.S.C. 154(b) by 0 days.

(21) Appl. No.: 10/366,877

(22) Filed: Feb. 14, 2003

(65) Prior Publication Data

US 2003/0156027 A1 Aug. 21, 2003

(30) Foreign Application Priority Data

Feb. 18, 2002 (JP) ..... 2002-039680

(51) Int. Cl.[7] ..... G08B 13/00
(52) U.S. Cl. ..... 340/541; 340/556
(58) Field of Search ..... 340/541, 541.1, 340/541.2, 555, 556, 557

(56) References Cited

U.S. PATENT DOCUMENTS 5,786,760 A * 7/1998 Suzuki et al. ..... 340/541
6,204,762 B1 * 3/2001 Dering et al. ..... 340/541
6,265,972 B1 * 7/2001 Lee ..... 340/541

FOREIGN PATENT DOCUMENTS

JP 5-143874 A * 6/1993 ..... G08B/13/196
JP 2000-099835 4/2000

* cited by examiner

*Primary Examiner*—Jeffery Hofsass
*Assistant Examiner*—Jennifer Stone

(57) ABSTRACT

To provide an intrusion detecting device capable of generating one of different warnings in proper timing dependent on the behavior of an intruder entering an alert region to thereby browbeat the intruder effectively, the intrusion detecting device (1) includes a plurality of sensor units (8 and 9), a sound generating device (29) capable of generating first and second warnings different from each other one at a time, and a warning generating unit (23). The sensor units (8 and 9) have a plurality of alert areas (A1 to A4) defined from a site distant from and to another site near to a subject to be monitored for security purpose and operable to detect an intruder H entering any of the alert areas (A1 to A4). The warning generating unit (23) is operable to cause the sound generating device (29) to issue the first warning when detection is made by the sensor unit (8), and also to cause the sound generating device (29) to issue the second warning when detection is made by at least the sensor unit (9) during a first predetermined length of time T1 subsequent to the detection by such sensor unit (8).

6 Claims, 4 Drawing Sheets

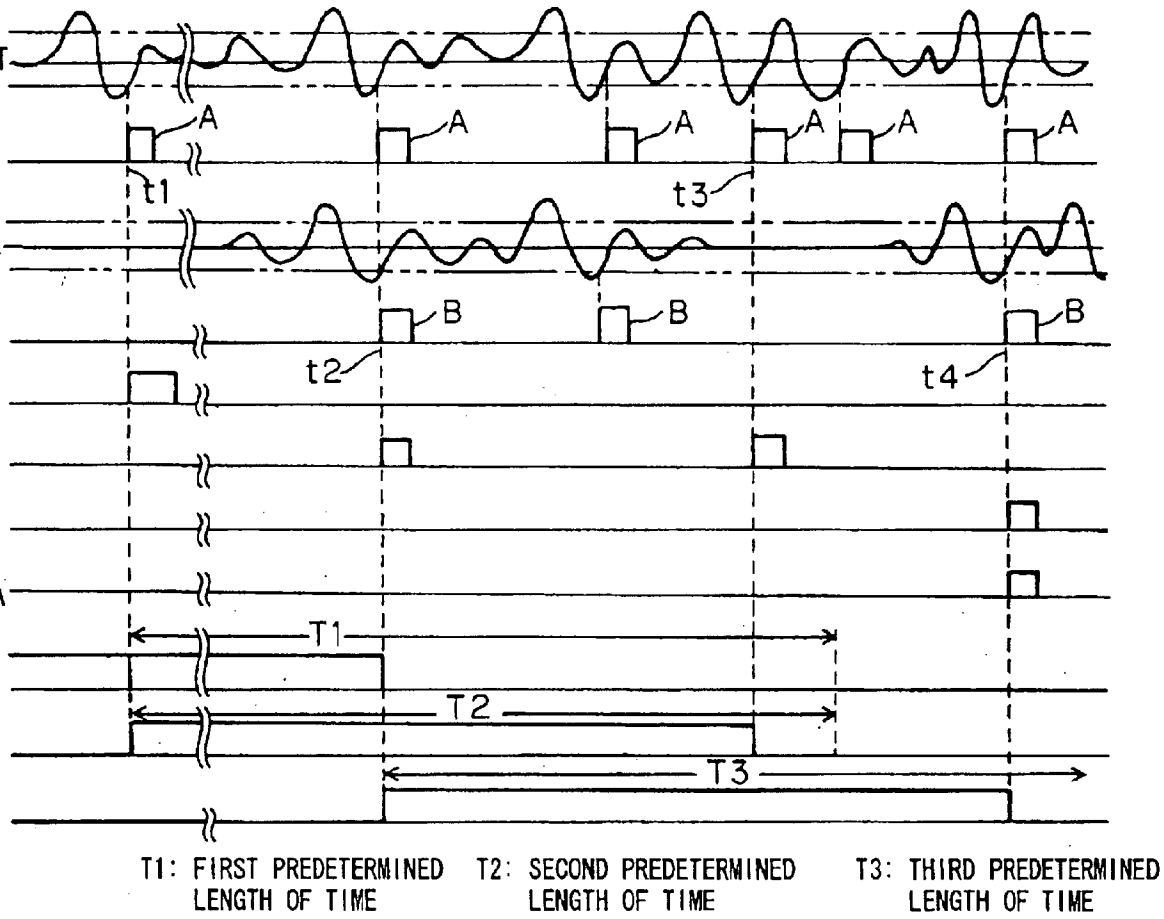
Fig. 4A:FIRST SIGNAL PROCESSING CKT
Fig. 4B:FIRST LEVEL DETECTING CKT
Fig. 4C:SECONDSIGNAL PROCESSING CKT
Fig. 4D:SECOND LEVEL DETECTING CKT
Fig. 4E:FIRST WARNING OUTPUT UNIT
Fig. 4F:SECOND WARNING OUTPUT UNIT
Fig. 4G:THIRD WARNING OUTPUT UNIT
Fig. 4H:SECURITY MONITORING CAMERA
Fig. 4I:FIRST TIMER CKT
Fig. 4J:SECOND TIMER CKT
Fig. 4K:THIRD TIMER CKT

INTRUSION DETECTING DEVICE

BACKGROUND OF THE INVENTION

1. Field of the Invention

The present invention generally relates to an intrusion detecting device and, more particularly, to the intrusion detecting device for anticrime use for detecting an intruder entering in a guarded or alert region, which is defined in the outdoors of a building such as a factory or a dwelling house, and for generating a warning signal for warning or intimidation for the purpose of driving the intruder away from the guarded region.

2. Description of the Prior Art

The intrusion detecting device of the kind referred to above, which has hitherto been used and is currently used in practice, make use of an infrared detecting sensor of a passive type or a projection type for detecting an intruder and is generally classified into two types. One type is so designed and so configured as to generate the same voice warning repeatedly so long as the presence of an intruder in a guarded or alert region is detected. The other type is so designed and so configured as to drive a buzzer or siren and/or to activate a warning light when the presence of an intruder in a guarded or alert region is detected.

It has, however, been found that those types have their own problems. Specifically, repeated generation of the same voice warning repeatedly such as with the intrusion detecting device of the first mentioned type involves a problem in that a potential intruder can sooner or later apprehend the pattern of operation of the intrusion detecting device and, therefore, the effective intimidation by the voice warning generated repeatedly can not be expected. Where the intrusion detecting device is so designed and so configured to generate a voice message of a kind that is hard-and-fast in an attempt to increase the effectiveness of browbeating, this hard-and-fast voice message is generated even to a unremorseful visitor entering a guarded area, causing such visitor to be set aback and, accordingly, the user of the intrusion detecting device will feel hard to use it.

On the other hand, the intrusion detecting device capable of driving the buzzer or siren and/or activating the warning light with the considerable amount of light is generally set in operation during the nighttime and, accordingly, loud sound and/or flashing light so generated will constitute a nuisance to those living in the neighborhood. Thus, this type of the intrusion detecting device is not well suited for use in the residential district.

Also, an anti-thief security assembly is known which is so constructed as to include two intrusion detecting devices positioned at respective sites distant from and near to a building in order to define associated alert areas. This anti-thief security assembly is known to operate in such a manner that when one of the intrusion detecting devices assigned to monitor the alert area distant from the building detects the presence of an intruder entering into such distant alert area, this intrusion detecting device can generate a voice warning including a moderate message, but when the other intrusion detecting device assigned to monitor the alert area near to the building detects the presence of an intruder entering into such near alert area, this intrusion detecting device can generate a voice warning including a strict message. However, this anti-thief security assembly requires the use of two detecting devices and, correspondingly, two voice sources, resulting not only in complexities in wiring and installation, but also in increase of the cost involved.

In view of the foregoing, the Japanese Laid-open Patent Publication No. 2000-99835, for example, discloses an anti-thief sensor device including a sensor unit and an alarm outputting unit both integrally encased in a single housing. This known anti-thief sensor device is so designed and so configured that when the sensor unit keeps detecting the presence of an intruder entering the alert area, contents of a warning sound generated thereby can vary stepwise with the passage of time subsequent to the time of detection of the intruder. Specifically, with the anti-thief sensor device of the type discussed above, as the time passes subsequent to the time of detection of the intruder, the volume of the warning sound varies from a small blast to a full blast or the outputting cycle of the warning sound varies.

Considering that, when an intruder is kept being detected, the anti-thief sensor device discussed above merely changes the manner of outputting the warning sound only based on the passage of time subsequent to the time of detection of the intruder entering the alert area and that the manner of outputting the warning sound varies in a plurality of predetermined stages, change of the warning sound would be readily apprehended by an intruder. More specifically, since the warning sound varies in the plurality of the predetermined stages regardless of the behavior of the intruder within the alert area, it is possible for the intruder to slyly apprehend that the warning sound would not change from one stage to another in a timing dependent on the behavior of the intruder. Once the intruder so apprehends the way the anti-thief sensor device works, he or she would no longer feel surprised even when the warning sound is generated during his or her subsequent attempt to intrude into the alert area and would be able to stay cool enough to analyze the pattern of change of the generated warning sound, wherefore the anti-thief sensor device would no longer bring a psychological effect on the mind of the intruder. Thus, the known anti-thief sensor device, too, is generally ineffective to browbeat the intruder and, hence, to provide an intended security against possible intruders.

SUMMARY OF THE INVENTION

In view of the foregoing, the present invention is devised to provide an intrusion detecting device capable of generating one of different warnings in a proper timing dependent on the behavior of an intruder entering an alert region to thereby browbeat the intruder effectively.

In order to accomplish the foregoing objects, the present invention herein provides an intrusion detecting device including a plurality of sensor units, a sound generating device capable of generating first and second warnings different from each other one at a time, and a warning generating unit. The plural sensor units have a plurality of alert areas defined from a site distant from and to another site near to a subject to be monitored for security purpose and are operable to detect an intruder entering any of the alert areas. The warning generating unit is operable to cause the sound generating device to issue the first warning when detection is made by one of the sensor units, and also to cause the sound generating device to issue the second warning when detection is made by at least another one of the sensor units during a first predetermined length of time subsequent to the detection by such one of the sensor units.

The intrusion detecting device of the present invention generates the first warning against an intruder, moving from the distant alert area to the near alert area relative to the site of installation of the device, in a proper timing when the intruder intruding the distant alert area is detected. Also when the intruder further moves to one of the alert areas nearer to the site of the device subsequent to the generation of the first warning, a different sensor unit associated with this alert area detects the intruder to then generate the second warning different from the first warning. Accordingly, in the event that the intruder continues moving from the distant alert area towards the near alert area with taking notice of the warning, the different warnings can be generated at the timing at which the intruder enters the different alert area.

In such case, if the first warning is employed in the form of a relatively polite voice message and the second warning is in the form of a hard-and-fast voice message, the intruder can be threatened or pressed to such an extent as to be placed under the impression that his or her behavior at any place would be monitored by the owner of a building, in view of the fact that not only does the warnings change in succession each time the intruder makes a motion, but also the contents of the warnings varies from a polite message to a hard-and-fast message with the change of the warnings. Accordingly, the intrusion detecting device of the present invention is indeed effective in making the intruder entering the alert areas give up committing crime and then driving the intruder away from such alert areas immediately and quickly to thereby achieve a desired anti-crime effect.

In one preferred embodiment of the present invention, the sound generating device may have an additional capability of generating a third warning that is different from the first warning. In such case, the warning generating unit is also operable to cause the sound generating device to issue the third warning when further detection is made only by such one of the sensor units during a second predetermined length of time subsequent to the detection by such one of the sensor units. This is particularly advantageous in that not only can the content of the warning be changed upon successive detection by the same sensor unit, that is, in the event that movement of the intruder within the same alert area is successively detected, but also the warning is generated each time the intruder moves within a predetermined length of time. Thus, the intrusion detecting device is effective in forcing the intruder to recognize that the content of the warning has not changed according to a predetermined pattern, but any movement of the intruder within the alert area is substantially completely monitored, in view of the fact that even though the intruder makes a slight movement within the same place, the content of the warning changes.

In another preferred embodiment of the present invention, the sound generating device may have a further capability of generating a fourth warning, in which case the warning generating unit is also operable to cause the sound generating device to issue the fourth warning when detection is made by such at least another one of the sensor units during a third predetermined length of time subsequent to the previous detection by such at least another one of the sensor units. This is particularly advantageous in that in the event that, for example, the intruder remains within the alert area near to a building and makes any motion despite the fact that the warnings have been generated, the fourth warning, the content of which is extremely hard-and-fast, can be issued repeatedly.

In a further preferred embodiment of the present invention, the intrusion detecting device may further include a security monitoring camera for monitoring any of the alert areas described above, and an imaging control unit for activating the security monitoring camera in synchronism with generation of one of the second to fourth warnings. This is particularly advantageous in that based on a photograph of the intruder taken in synchronism with detection of the intruder, the facial features, build and style of dress of the intruder having entered the alert region can be identified.

BRIEF DESCRIPTION OF THE DRAWINGS

In any event, the present invention will become more clearly understood from the following description of preferred embodiments thereof, when taken in conjunction with the accompanying drawings. However, the embodiments and the drawings are given only for the purpose of illustration and explanation, and are not to be taken as limiting the scope of the present invention in any way whatsoever, which scope is to be determined by the appended claims. In the accompanying drawings, like reference numerals are used to denote like parts throughout the several views, and:

FIGS. 4A to 4K illustrate various signals appearing in the electric circuit of the intrusion detecting device of the present invention, which are shown in timed relation to each other, respectively.

DETAILED DESCRIPTION OF THE EMBODIMENTS

Hereinafter, a preferred embodiment of the present invention will be described in detail with reference to the accompanying drawings.

Figure 1:
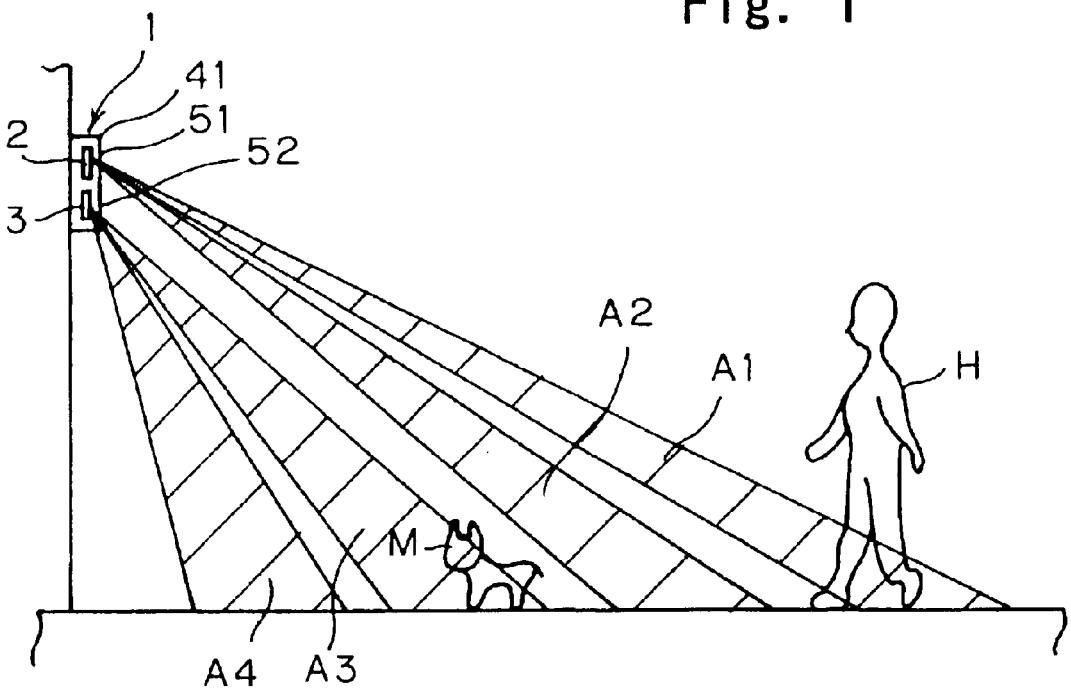
FIG. 1 is a schematic side view showing an optical layout around the site of installation of an intrusion detecting device embodying the present invention.

FIG. 1 schematically illustrates a side view of an optical layout around the site of installation of an intrusion detecting device 1 embodying the present invention. The intrusion detecting device 1 shown therein is of a type capable of being mounted on the exterior wall or the like of a building such as a factory or a dwelling house for monitoring an outdoor alert region to detect entry of an intruder into such outdoor alert region. This intrusion detecting device 1 includes first and second detecting element pairs 2 and 3 both encased within a casing 41. Each of the first and second detecting element pairs 2 and 3 cooperates with a respective optical device 51 and 52, such as a Fresnel lens positioned in front of the first and second detecting element pairs 2 and 3 and fitted to the casing 41, in order to define two alert sub-regions A1 and A2 or A3 and A4 encompassed substantially within the outdoor alert region. Thus, it will readily be seen that the first and second detecting element pairs 2 and 3 altogether define four non-overlapping alert areas A1 to A4, covering the alert region from an area distant from the intrusion detecting device 1 to an area near to the intrusion detecting device 1, as shown in FIG. 1.

Each of the first and second detecting element pairs 2 and 3 has a pair of infrared detecting elements, made up of pyroelectric elements, which are electrically connected with each other in reverse polarity relation to each other. Although not shown, each of the alert areas A1 to A4 referred to above has a pair of sub-areas associated respectively with these infrared detecting elements. Infrared energies emitted from a human body H, a small animal M and/or a background surface within the alert areas A1 to A4 are collected by the optical devices 51 and 52 to be subsequently received by the corresponding detecting element pairs 2 and 3. It is to be noted that the human body H is that of an intruder entering into the alert areas A1 to A4.

Figure 2:
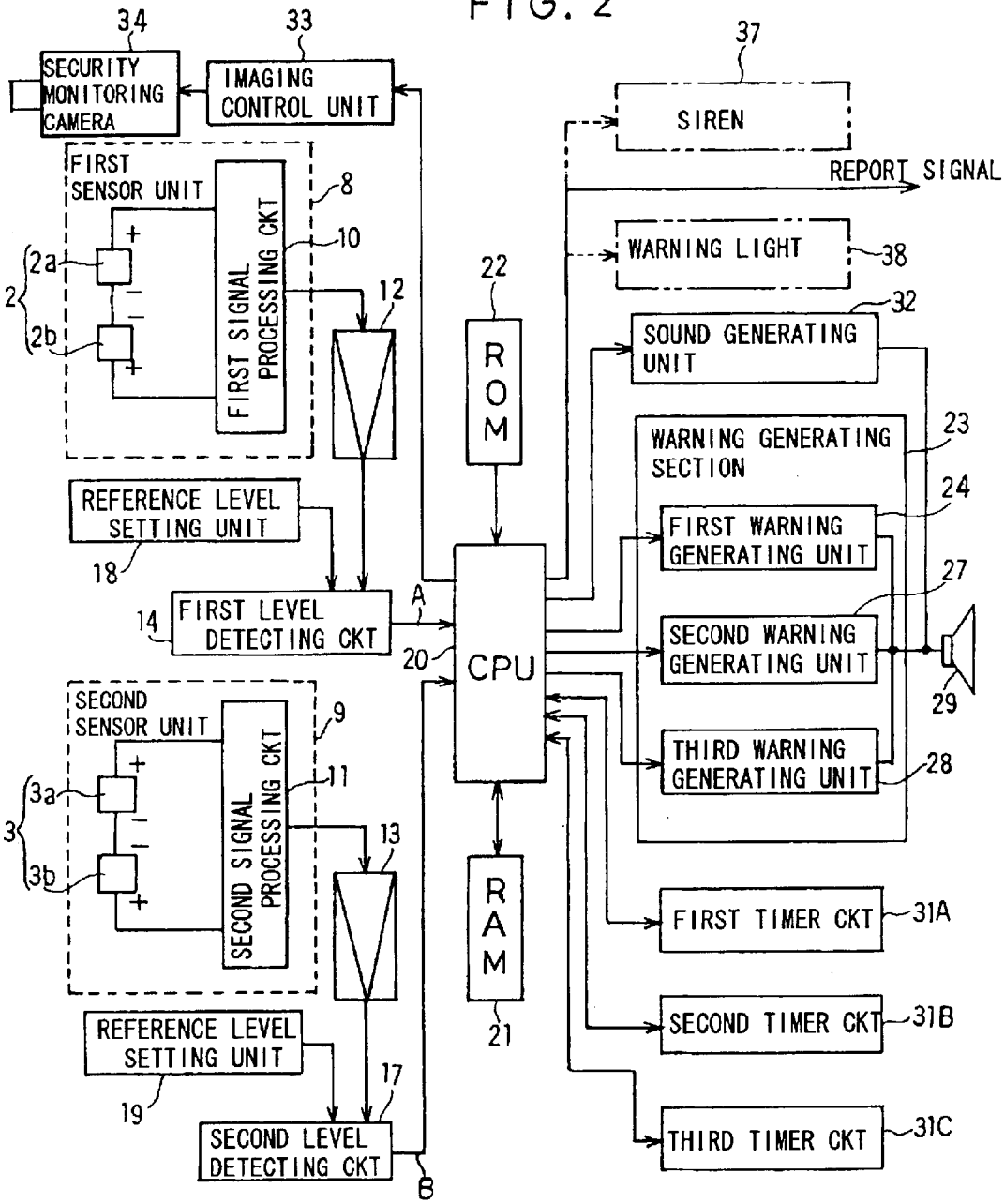
FIG. 2 is a circuit block diagram showing an electric circuit of the intrusion detecting device embodying the present invention.

FIG. 2 illustrates a circuit block diagram of an electric circuit employed in the intrusion detecting device 1. As shown therein, the first detecting element pair 2 includes infrared detecting elements 2*a* and 2*b* connected in series in reverse polarity relation to each other with a first signal processing circuit 10 and, similarly, the second detecting element pair 3 includes infrared detecting elements 3*a* and 3*b* connected in series in reverse polarity relation to each other with a second signal processing circuit 11. Each of the first and second signal processing circuits 10 and 11 is operable to output a detection signal of a voltage level proportional to the amount of infrared rays incident on the respective pair of the infrared detecting elements 2*a* and 2*b* or 3*a* and 3*b*. It is to be noted that the detecting element pairs 2 and 3 and the associated first and second signal processing circuits 10 and 11 altogether constitute first and second sensor units 8 and 9, respectively.

The first signal processing circuit 10 outputs a first detection signal corresponding to the sum of electrical charges, generated from the associated infrared detecting elements 2*a* and 2*b*, which charges are of reverse polarity to each other, whereas the second signal processing circuit 11 similarly outputs a second detection signal corresponding to the sum of electrical charges, generated from the associated infrared detecting elements 3*a* and 3*b*, which charges are of reverse polarity to each other. The respective output (detection) signals from the first and second signal processing circuits 10 and 11 are, after having been amplified by corresponding amplifier circuits 12 and 13, inputted to first and second level detecting circuits 14 and 17, respectively. Each of the first and second level detecting circuits 14 and 17 is made up of a comparator circuit and a counter circuit. The first level detecting circuit 14 is operable to compare at all times the signal intensity of the signal inputted thereto, that is, the level of the signal corresponding to the amount of change of the infrared flux incident on the infrared detecting elements 2*a* and 2*b*, with a predetermined reference level set by a first reference level setting unit 18, and then to generate first detection pulses A to a control unit 20 when the level of the detection signal inputted to the first level detecting circuit 14 exceeds the predetermined reference level. Similarly, the second level detecting circuit 17 is operable to compare at all times the signal intensity of the signal inputted thereto, that is, the level of the signal corresponding to the amount of change of the infrared flux incident on the infrared detecting elements 3*a* and 3*b*, with a predetermined reference level set by a second reference level setting unit 19, and then to generate second detection pulses B to the control unit 20 when the level of the detection signal inputted to the second level detecting circuit 17 exceeds the predetermined reference. The control unit 20 referred to above may be comprised of a central processing unit.

In order to avoid an erroneous operation resulting from reception of an external interfering light or the like, each of the first and second level detecting circuits 14 and 17 is so designed and so configured that when the respective level detecting circuit 14 or 17 receives the detection signal from the associated amplifier circuit 12 or 13 for the first time, such level detecting circuit 14 or 17 outputs an initial one of the first or second detection pulses A or B after a predetermined number of, for example, three detection signals are received in succession, but outputs the first or second detection pulse A or B each time such level detecting circuit 14 or 17 receives the detection signal from the corresponding amplifier circuit 12 or 13 ever since then.

The control unit 20 when receiving the first or second detection signal A or B from the associated level detecting circuit 14 or 17 automatically executes a program, stored in a read-only memory (ROM) 22, based on data stored in a random access memory (RAM) 21, to thereby automatically control the intrusion detecting device 1. More specifically, the control unit 20 when receiving the initial first detection pulses A from the first level detecting circuit 14, automatically drives a first warning output unit 24 in a warning generating section 23 to cause a loudspeaker 29, which is a sound generating device, to generate a first voice warning, and also activates a first timer circuit 31A from the timing t1 at which the first voice warning is outputted and, at the timing at which the initial second detection pulses B is inputted thereto from the second level detecting circuit 17, that is, at a timing t2 at which the detection pulses A and B from the first and second level detecting circuits 14 and 17, respectively, are inputted in the illustrated embodiment, before the first timer circuit 31A completes counting of a first predetermined length of time T1, for example, 20 seconds, the control unit 20 automatically drives a second warning output unit 27 to cause the loudspeaker 29 to generate a second voice warning that is different from the first voice warning.

It is to be noted that since in the illustrated embodiment the alert areas A1 to A4 are defined so as to extend towards a ground surface at a location spaced a relatively small distance from the site of installation of the intrusion detecting device 1 so that the intrusion detecting device 1 can discriminate the human body H from the small animal M, the human body H can be detected within any of the first and second alert areas A1 to A4 in the event that the human body H approaches the building, that is, the intrusion detecting device 1. However, if the intrusion detecting device 1 is positioned at a level sufficiently higher than the human body H so as to define the alert region covering from an area distant from the intrusion detecting device 1 to an area near to the intrusion detecting device 1, the intrusion detecting device 1 can be so set as to enable only the first sensor unit 8 to detect the presence of the human body H when the latter is located distant from the building, but to enable only the second sensor unit 9 to detect the presence of the human body H when the latter is located near to the building. In such case, at the timing at which only the second detection pulse B is detected, the second warning output unit 27 can be driven to generate the second voice warning.

The control unit 20 yet activates a second timer circuit 31B at the timing t1 and drives, at the timing t3 at which only the first detection pulse A is inputted from the first level detecting circuit 14 before the second timer circuit 31B completes counting of a second predetermined length of time T2, for example, 20 seconds, the second warning output unit 27 to cause the loudspeaker 29 to generate a third voice warning that is different from the first voice warning. In such case, the third voice warning has the same contents as the second voice warning.

Furthermore, the control unit 20 activates a third timer circuit 31C at the timing t2 at which the initial second detection pulses B is outputted from the second level detecting circuit 17, and drives a third warning output unit 28 to cause the loudspeaker 29 to generate a fourth voice warning at the timing at which the second detection pulse B is inputted thereto from the second level detecting circuit 17, that is, at a timing T4 at which the detection pulses A and B from the first and second level detecting circuits 14 and 17, respectively, are inputted in the illustrated embodiment, before the third timer circuit 31C completes counting of a third predetermined length of time T3 , for example, 20 seconds. At the same time the control unit 20 also outputs a report signal used to notify the owner of or someone resident in the building or a security company.

Yet, the control unit 20, when a plurality of the second detection pulses B are inputted only from the second level detecting circuit 17, determines the presence of a small animal M and, accordingly, drives a sound generating unit 32 to cause the loudspeaker 29 to generate a warning sound which is not a human voice, but which may be, for example, sounds of a drum or a dog's bark, to thereby browbeat the small animal M entering in the alert region. Again, in synchronism with generation of one of the first to fourth voice warnings, for example, the fourth voice warning, the control unit 20 generates to an imaging control unit 33 a command necessary to activate a security monitoring camera 34. It is to be noted that the term "synchronism" referred to above should be construed as encompassing not only the same time, but also the timing delayed a predetermined, small length of time from the timing at which the voice warning is generated. The control unit 20 may be so constructed as to activate a siren 37 or a warning light 38 in concurrent with the output of the fourth voice warning.

Figure 3:
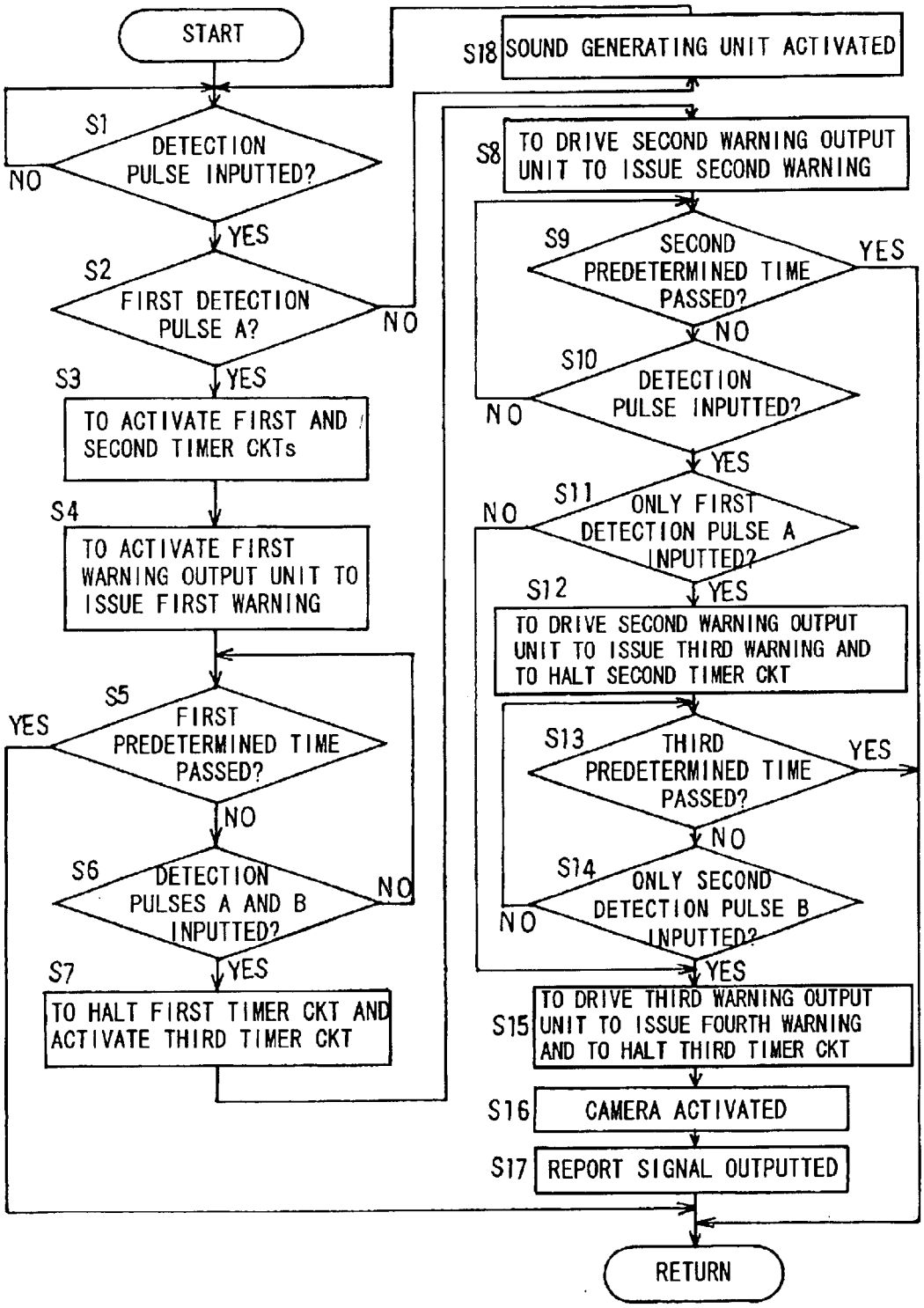
FIG. 3 is a flowchart showing the sequence of control performed by a control unit employed in the intrusion detecting device of the present invention.

In the next place, the sequence of control performed by the control unit 20 discussed above will now be described in detail with reference to the flowchart shown in FIG. 3 and the timing chart shown in FIG. 4. The control unit 20 monitors at all times if the detection pulses A or B is inputted thereto from one of the first and second level detecting circuits 14 and 17 (Step S1). Assuming that an intruder H enters the alert areas A1 and A2 distant from the building, the first signal processing circuit 10 outputs a signal of a high signal level resulting from charges of alternate polarity as shown in FIG. 4A, which are generated in response to incidence of infrared fluxes on the infrared detecting elements 2*a* and 2*b*. If this output signal from the first signal processing circuit 10 exceeds a range bound between positive and negative reference levels shown by the double-dotted lines in FIG. 4A, the first level detecting circuit 14 outputs a first detection pulse A as shown in FIG. 4B.

When the control unit 20 determines at step S1 that the detection pulse has been inputted, a decision is made at step S2 to determine if the detection pulse A so outputted is the first detection pulse A outputted from the first sensor unit 8 or not. Since in the illustrated embodiment it is assumed that the detection signal outputted is the first detection pulse A outputted from the first sensor unit 8, the control unit 20, at the timing t1 at which the first detection pulse A is determined as the first one, generates a command necessary to activate the first and second timer circuits 31A and 31B associated with the first sensor unit 8 at step S3, and another command necessary to drive the first warning output unit 24 to cause the loudspeaker 29 to generate the first voice warning at the timing t1 as shown in 4E (Step S4).

Each of the first to third voice warnings outputted respectively from the first to third warning output units 24, 27 and 28 represents a warning voice which the user of the intrusion detecting device can select from a plurality of voice messages. However, the message represented by the first voice warning outputted from the first warning output unit 24 is a rather moderate warning message such as "You are entering the alert area. Please keep off."

Then, whether or not the first predetermined length of time T1, for example, 20 seconds has already passed is monitored on the basis of the count of the first timer circuit 31A at step S5. If it is determined that the first predetermined length of time T1 has already passed, the program flow returns to the initial step S1. When prior to the passage of the first predetermined length of time T1 the detection pulses A and B respectively from the first and second level detecting.

Thereafter, the control unit 20 monitors the counting of the second predetermined length of time T2 performed on the basis of the time count data of the second timer circuit 31B at step S9 and, also, input of the detection pulses A and B from the first and second level detecting circuits 14 and 17 at step S10 and, when the input of the detection pulses are confirmed, the control unit 20 then performs a decision at step S11 to determine whether or not the inputted detection pulse is only the first detection pulse A.

In the embodiment herein discussed, after the second detection pulse B from the second level detecting circuit 17 has diminished as shown in FIG. 4D, the first detection pulse A is generated again from the first level detection circuit 14, as shown in FIG. 4B, within the second predetermined length of time T2 counted by the second timer circuit 31B, and the second warning output unit 27 is driven at the timing t3 of the generation of this first detection pulse A to generate the third voice warning (identical with the second voice warning) while the counting performed by the second timer circuit 31B is halted at step S12. This occurs when the intruder H having moved from the first alert areas A1 and A2 into the second alert areas A3 and A4 moves back to the first alert areas A1 and A2 as a result of having been warned by the second voice warning. The second and third voice warnings are so designed as to be in the form of a voice message that is harder-and-faster than that represented by the first voice warning. By way of example, the second and third voice warnings may be the voice message speaking "You are entering the alert area. Go away from here within a minute, or your unauthorized entry will be notified."

As described above, the third timer circuit 31C is activated from the timing t2 at which the initial second detection pulse B is generated from the second level detecting circuit 17 and the counting of the third predetermined length of time T3 and the inputting of the second detection pulse B from the second level detecting circuit 17 are monitored at steps S13 and S14, respectively. As shown in FIG. 4D, at the timing T4 at which the second detection pulse B is inputted, the fourth voice warning generated by the third warning output unit 28 as shown in FIG. 4G is outputted from the loudspeaker 29 and the counting of the third timer circuit 31C is halted at step S15. This occurs when the intruder H having entered the alert region still remains within the alert areas A3 and A4 that are near to the building. Also, the control unit 20 supplies a command to the imaging control unit 33 to activate the security monitoring camera 34 at step S16 and, at the same time, a message signal indicative of the presence of the intruder within the alert region is outputted at step S17 to notify the owner of or someone resident in the building and/or a security company. The fourth voice warning may be in the form of a voice message speaking like "Your unauthorized entry has been notified and recorded with the security monitoring camera," and is thus hard-and-fast.

If at step S14 the control unit 20 determines that what has been detected is not only the first detection pulse A, that is, both of the first and second detection pulses A and B have been detected, the program flow goes to step S15 at which the fourth voice warning generated by the third warning output unit 28 is outputted from the loudspeaker 29 and, at the same time, the counting by the third timer circuit 31C is halted. On the other hand, in the event that it is determined at step S2 that what has been initially inputted is only the second detection pulse B, it is deemed that the intruder entering the alert region is actually a small animal and, accordingly, the sound generator 31 is triggered on at step S18.

As discussed above, in the event that the intruder H moves around after he or she has entered the second alert areas A3 and A4 near to the building, not only is the fourth voice warning issued, but also the security monitoring camera 34 photographs the intruder H within the alert region. Accordingly, based on the photograph or video taken with the security monitoring camera 34, the facial features, build and style of dress of the intruder H having entered the alert region, that is, the first and second alert areas A1 to A4 can be identified. Thus, the photograph so taken can be used in identifying the intruder at the time of or subsequent to the event, and also used as an evidence to be submitted to the police and/or the security company. It is to be noted that the security monitoring camera 34 discussed above is so designed and so positioned as to cover the entire alert region including the first and second alert areas A1 to A4 and, accordingly, the timing for triggering such camera may be not only synchronized with the generation of the fourth voice warning, but also synchronized with the generation of the first or second voice warning. It is also to be noted that the security monitoring camera 34 may be so designed and so positioned as to cover only a part of the alert region, for example, only the second alert areas A3 and A4 near to the building.

With the intrusion detecting device 1 of the structure described above, it is clear that the first voice warning is first generated at the timing at which the intruder H enters the first alert areas A1 and A2 distant from the house; at the timing at which after the first voice warning has been generated, if the intruder H subsequently enters the second alert areas A3 and A4 near to the building, both the first and second sensor units 8 and 9 detect the intruder and the second voice warning different from the first voice warning is then generated; and the fourth voice warning is generated in the event that the intruder having entered the second alert areas A3 and A4 still moves around within such second alert areas A3 and A4. Accordingly, in the event that the intruder H continues moving from an area distant from the building towards an area near to the building with taking no notice of the voice warnings then generated, not only can the voice warnings change in succession at an appropriate timing at which the intruder H enters the different alert areas A1 to A4, but also the voice message represented by each of the respective voice warnings changes with the change of the voice warnings, i.e., from a polite message to a hard-and-fast message. Thus, with the intrusion detecting device 1 embodying the present invention, since the second or fourth voice warning is generated whenever movement of the intruder within the same alert areas A1 to A4 is detected, any slight motion of the intruder H even though the intruder H does little move within the same place results in generation of the voice warning. Accordingly, the intrusion detecting device 1 is effective in forcing the intruder H to recognize that the warning does not change according to a predetermined pattern, and also any movement of the intruder H within the alert region is substantially completely monitored.

Because of the reason discussed above, the intruder H can be threatened or pressed to such an extent as to be placed under the impression that his or her behavior at any place would be monitored by the owner of the building. Accordingly, the intrusion detecting device 1 of the present invention is indeed effective in making the intruder H having entered the alert areas A1 to A4 give up committing crime and driving the intruder H away from the premises immediately and quickly.

In the embodiment described hereinbefore, the first to fourth voice warnings have been described as generated when the corresponding initial detection pulses A and B are inputted. However, in place of this, a counter circuit for counting the number of the detection pulses may be employed so that the first to fourth voice warnings can be generated only when a predetermined number of the detection pulses counted thereby is inputted. By so doing, the warning will not be issued when the intruder H moves away from the alert areas A1 to A4 immediately after he or she has listened to the warning, thereby suppressing unnecessary generation of the warning.

Also, in the embodiment described hereinbefore, reference has been made to the use of the two sensor units 8 and 9. However, in a broad aspect of the present invention, the number of the sensor units is not always limited to two such as shown and described, but three or more sensor units may be employed. In such case, arrangement has to be made so that a voice warning in the form of a harder-and-faster warning message can be outputted each time the intruder H moves towards an alert area of the alert region that is rather close to the building, and that each time the event that the intruder stops and makes a bodily motion within the same alert area is detected, a warning to be generated upon entry into the adjoining alert areas close to the building can be outputted.

Although the present invention has been fully described in connection with the preferred embodiments thereof with reference to the accompanying drawings which are used only for the purpose of illustration, those skilled in the art will readily conceive numerous changes and modifications within the framework of obviousness upon the reading of the specification herein presented of the present invention. Accordingly, such changes and modifications are, unless they depart from the scope of the present invention as delivered from the claims annexed hereto, to be construed as included therein.

What is claimed is:

1. An intrusion detecting device which comprises:

first and second sensor units having respective non-overlapping distant and near alert areas defined from a site distant from and to another site near to a subject to be monitored for security purpose and operable to detect an intruder entering distant and near alert areas, respectively;

a sound generating device capable of generating one at a time, a first warning prerecorded for the distant alert area and a second warning prerecorded for the near alert area, said first and second warnings being different from each other;

a first timer circuit counting a first predetermined length of time subsequent to a first detection by the first sensor unit in the distant alert area; and a warning generating unit operable to automatically cause the sound generating device to issue the first warning when the first detection is made by the first sensor unit in the distant alert area, and also to automatically cause the second generating device to issue the second warning when a second detection is made by the second sensor unit in the near alert area during the first predetermined length of time subsequent to the first detection by the first sensor unit.

2. The intrusion detecting device as claimed in claim 1, further comprising a second timer circuit counting a second predetermined length of time subsequent to the first detection by the first sensor unit in the distant alert area and wherein said sound generating device has an additional capability of generating a third warning that is prerecorded for the distant alert area and different from the first warning, and the warning generating unit is also operable to automatically cause the sound generating device to issue the third warning when detection is made only by the first sensor unit in the distant alert area during the second predetermined length of time subsequent to the first detection by the first sensor unit.

3. The intrusion detecting device as claimed in claim 1, further comprising a third timer circuit counting a third predetermined length of time subsequent to the second detection by the second sensor unit in the near alert area and wherein said sound generating device has a further capability of generating a fourth warning that is prerecorded for the near alert area and different from the first to third warnings, and the warning generating unit is also operable to automatically cause the sound generating device to issue the fourth warning when detection is made at least by the second sensor unit in the near alert area during the third predetermined length of time subsequent to the second detection by the second sensor unit.

4. The intrusion detecting device as claimed in claim 2, further comprising a security monitoring camera for monitoring at least a portion of the distant and near alert areas, and an imaging control unit for activating the security monitoring camera in synchronism with the generation of one of the second and third warnings.

5. The intrusion detecting device as claimed in claim 3, further comprising a security monitoring camera for monitoring at least a portion of the distant and near alert areas, and an imaging control unit for activating the security monitoring camera in synchronism with the generation of one of the second; third and fourth warnings.

6. An intrusion detecting device which comprises:

a plurality of sensor units, each sensor unit covering a plurality of non-overlapping alert areas defined from a site distant from and to another site near to a subject to be monitored for security purpose and operable to detect an intruder entering into the non-overlapping alert areas, the site distant alert area is monitored by a first sensor unit and the site near alert area is monitored by a second sensor unit;

a sound generating device for generating one of a first, a second, a third, and a fourth warning one at a time, the first, second, third, and fourth warnings being prerecorded and different from each other, the first and third warnings are for the site distant alert area and the second and fourth warnings are for the site near alert areas;

a warning generating unit operable to automatically cause the sound generating device to issue the first warning when detection is made by the first sensor unit, to automatically cause the sound generating device to issue the second warning when detection is made by the second sensor unit during a first predetermined length of time measured subsequent to the detection by the first sensor unit, to automatically cause the sound generating device to issue the third warning when detection is made by the first sensor unit during a second predetermined length of time measured subsequent to the detection by the first sensor unit, and to automatically cause the sound generating device to issue the fourth warning when detection is made by the second sensor unit during a third predetermined length of time measured subsequent to the detection by the second sensor unit;

a first timer circuit for counting the first predetermined length of time;

a second timer circuit for counting the second predetermined length of time;

a third timer circuit for counting the third predetermined length of time;

a security monitoring camera for monitoring at least portion of the non-overlapping alert areas, and an imaging control unit for activating the security monitoring camera in synchronism with the generation of one of the second, third, and fourth warnings, wherein the first, second, third, and fourth warnings provide different pre-recorded word messages, and wherein one of the second, third and fourth warnings include a word message indicating a camera is activated.

* * * * *